US006989483B2

(12) United States Patent
Ramsay

(10) Patent No.: US 6,989,483 B2
(45) Date of Patent: Jan. 24, 2006

(54) ADJUSTABLE TREMOLO BRIDGE

(76) Inventor: Donald Ramsay, 6881 Hazard Ave., Westminster, CA (US) 92683

( * ) Notice: Subject to any disclaimer, the term of this patent is extended or adjusted under 35 U.S.C. 154(b) by 12 days.

(21) Appl. No.: 10/756,070

(22) Filed: Jan. 12, 2004

(65) Prior Publication Data

US 2005/0150350 A1 Jul. 14, 2005

(51) Int. Cl.
*G10D 3/00* (2006.01)

(52) U.S. Cl. ..... 84/313

(58) Field of Classification Search ..... 84/313, 84/312 R, 307

See application file for complete search history.

(56) References Cited

U.S. PATENT DOCUMENTS 4,656,915 A 4/1987 Osuga
4,688,461 A 8/1987 Slroh
4,704,936 A 11/1987 Steinberger
4,984,493 A 1/1991 Schalle
5,392,680 A 2/1995 Stets
6,710,235 B2 * 3/2004 Hirayama ..... 84/313
6,797,870 B2 * 9/2004 Kang ..... 84/313

* cited by examiner

*Primary Examiner*—Kimberly Lockett

(74) *Attorney, Agent, or Firm*—I. Michael Bak-Boychuk

(57) ABSTRACT

A tremolo assembly is implemented for modulating the string tension on a guitar by mounting a bridge carrier on a sliding mount with the fore and aft displacement thereof effected by a transverse cam implemented fulcrum piece opposing the string tension. The sliding mount limits the bridge translation to the string plane, thus resolving all bending and lateral string forced. A forwardly and rearwardly aligned set of manual levers is then useful in modulating downward and upward the tension of the strings in unison against a set of bias springs.

19 Claims, 3 Drawing Sheets

FIG. 3
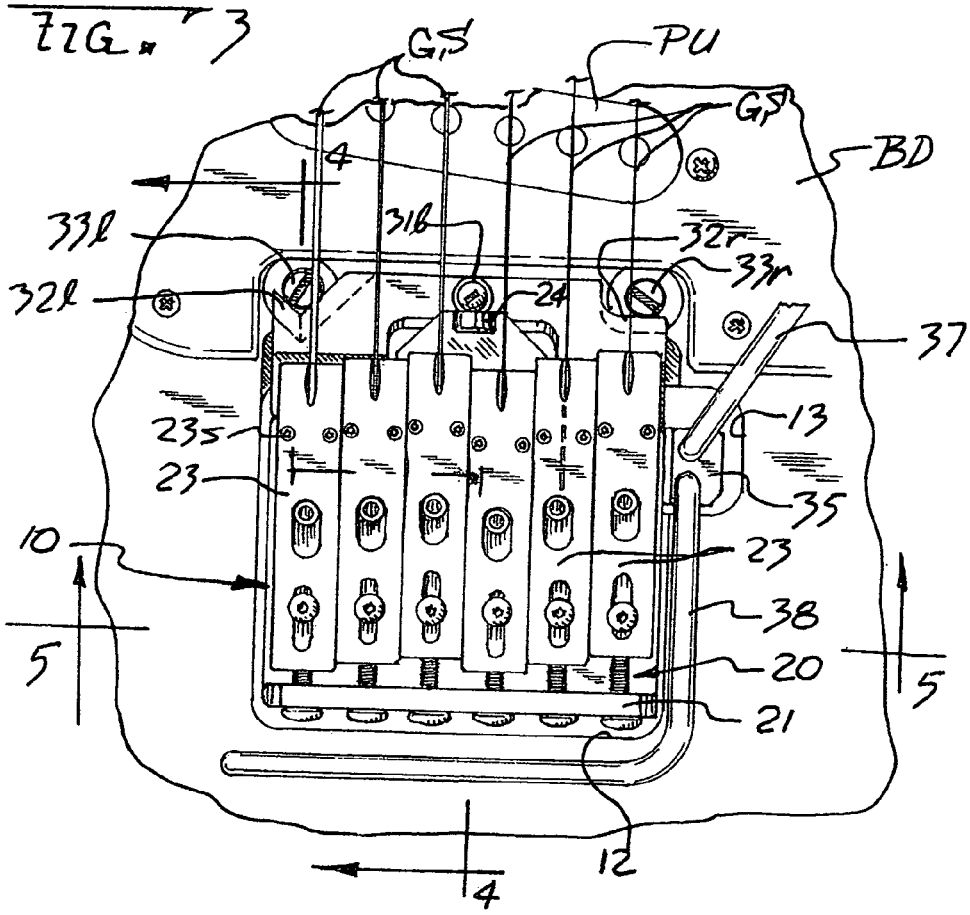
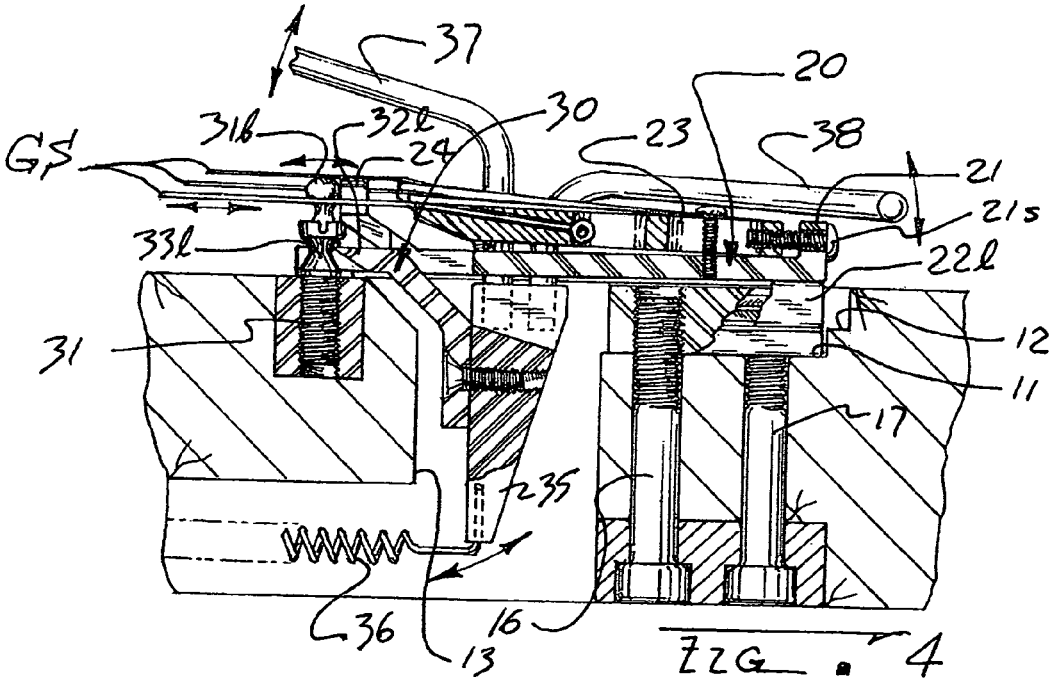
FIG. 4

ADJUSTABLE TREMOLO BRIDGE

BACKGROUND OF THE INVENTION

1. Field of the Invention

The present invention relates to tremolo devices useful in modulating the pitch of the strings on a guitar, and more particularly to a tremolo assembly that allows for linear modulation of an array of individually adjustable string terminals in response to the movement of a tremolo bar.

2. Description of the Prior Art

The rendition of music is often found more pleasing when the individual sounds are varied by small pitch modulations which combine in complex beats and harmonics with other concurrent sounds to produce a rich tone pattern. In popular music the convenience in attaining this pitch modulation is a highly desired facility and stringed instruments like guitars have had some mechanical developments in the past for the convenient rendition of this effect. The rendition of this effect, however, entails substantial manual facility which has led to a simplification of the mechanism itself, most often resulting in a structure that modulates all the strings in unison. With time and experience the richness of sound obtainable by these modulations became a matter of some further refinement and those engaged in the endeavor now desire the facility of selective modulation both upward and also downward from the selected tone with precise adjustment control over each excursion.

The past development of devices for manually modulating the pitch of a guitar has been extensive, to a point of acquiring its own nomenclature now referred to as a 'tremolo,' and one early example of such a mechanism can be found in the teachings of U.S. Pat. No. 2,741,146 to Fender. This and similar tremolo mechanisms are characterized by a pivotal structure supported in a transverse recess adjacent the string bridge and pivoted by manual articulation of a cantilevered bar, known as the tremolo bar, against a spring bias, thereby modulating the tensioning contact, and thus the pitch, of the strings. Various modifications of this general arrangement have been developed since then, as exemplified by the teachings of U.S. Pat. No. 6,015,945 to Borisoff, U.S. Pat. No 6,084,166 to Lee, U.S. Pat. No 5,783,763 to Schaller, et al. and others. While suitable for the purposes intended devices of this nature rely on pivotal motion of a common transverse structure against a bias spring, thus resulting in a string contact which induces repetitive application of bending stresses thereto. Since the pivotal center of this displacement is determined by the balance between the string contact and a return spring the resulting equilibrium contact position is poorly defined and the tuning precision of the instrument is therefore often compromised. Moreover, this same point of contact imprecision is exacerbated by the varying heights to which the various string are adjusted relative the pivotal center resulting in a resulting variation in the tremolo excursion of each string. The contact imprecision also tends to dampen string oscillations, reducing the length of time that a note is 'sustained' and the consequent absence of any individual string adjustment further reduces any effective adjustment for the interplay between the performer's fingers and the individual strings. A linear tremolo mechanism that allows precise adjustment of the tremolo excursions while also accommodating full adjustment control of each individual string is therefore extensively desired and it is one such mechanism that is disclosed herein.

SUMMARY OF THE INVENTION

Accordingly, it is the general purpose and object of the present invention to provide a bridge carrier that may be linearly translated in response to manual articulation of any one of a plurality of individually cantilevered tremolo bars.

Other objects of the invention are to provide a tremolo mechanism for modulating the pitch of all the strings of a guitar by way of linear displacement of a string bridge carrier.

Yet further objects of the invention are to provide a tremolo mechanism for a guitar in which the range of the tremolo excursion is conveniently adjusted by advancing a single screw.

Yet additional objects of the invention are to provide a tremolo mechanism effected by linear translation of a carrier supporting a bridge of a string instrument.

Briefly, these and other objects are accomplished within the present invention by providing a linear tremolo mechanism installed in a bridge recess formed in the guitar defined by a generally flat bridge carrier received for longitudinal movement within a peripheral recess formed around a central cavity in the guitar surface. This fore and aft carrier movement is fixed by longitudinal slides on the edges of a base piece secured within this central base cavity that also engage the edges of the carrier. All the string ends tied to the carrier exterior by individual string end fixtures are then displaced in unison according to the fore and aft motion of the carrier, modulating the tension and thus the pitch of the strings according to the direction of their movement. To induce this linear movement a fore and aft tremolo bar are each cantilevered from one end of a spring biased transverse fulcrum piece deployed in front of the bridge carrier on adjustable knife edge pivots to articulate an adjustably extended cam opposing the front edge of the carrier.

Those in the art will appreciate that this novel arrangement is particularly effective in developing both an increased and a decreased pitch modulation while also providing a very accurate knife edged pivot fulcrum for an accurately adjustable forcing point. The closely controlled linear displacement of the sliding carrier, moreover, renders the whole mechanism more accurate in retaining the preselected string tuning while also limiting any further repetitive bending, and sometimes breaking, the strings.

BRIEF DESCRIPTION OF THE DRAWINGS

FIG. 3 is a plan view detail illustrating the adjustment and manipulation aspects of the inventive bridge carrier;

FIG. 4 is a side view detail, in section, taken along line 4—4 of FIG. 3.

DESCRIPTION OF THE PREFERRED EMBODIMENT

Figure 1:
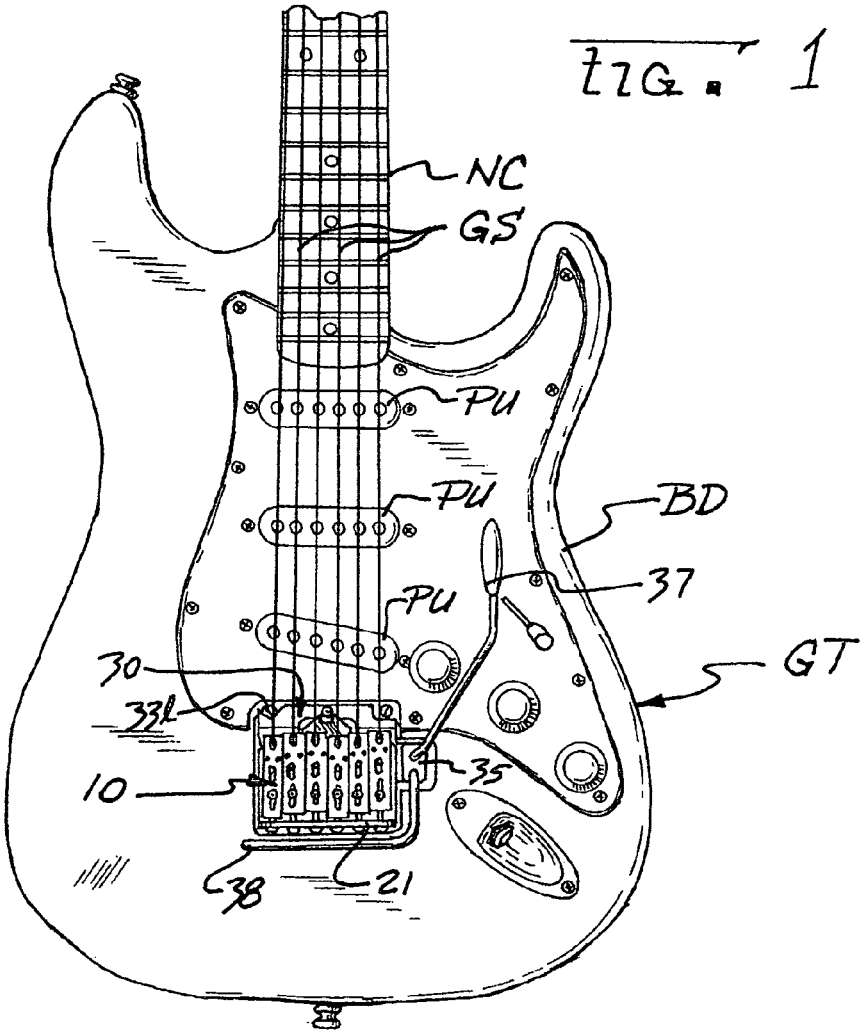
FIG. 1 is a front view of a guitar provided with an inventive linearly articulated bridge carrier for effecting upward and also downward pitch modulations of the strings of the guitar.
Figure 5:
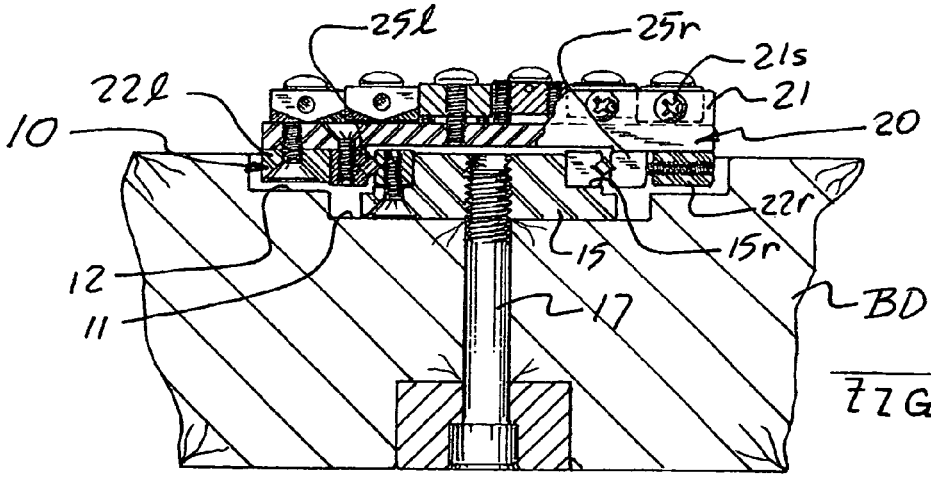
FIG. 5 is an end view detail, in section, taken along line 5—5 of FIG. 3.
Figure 2:
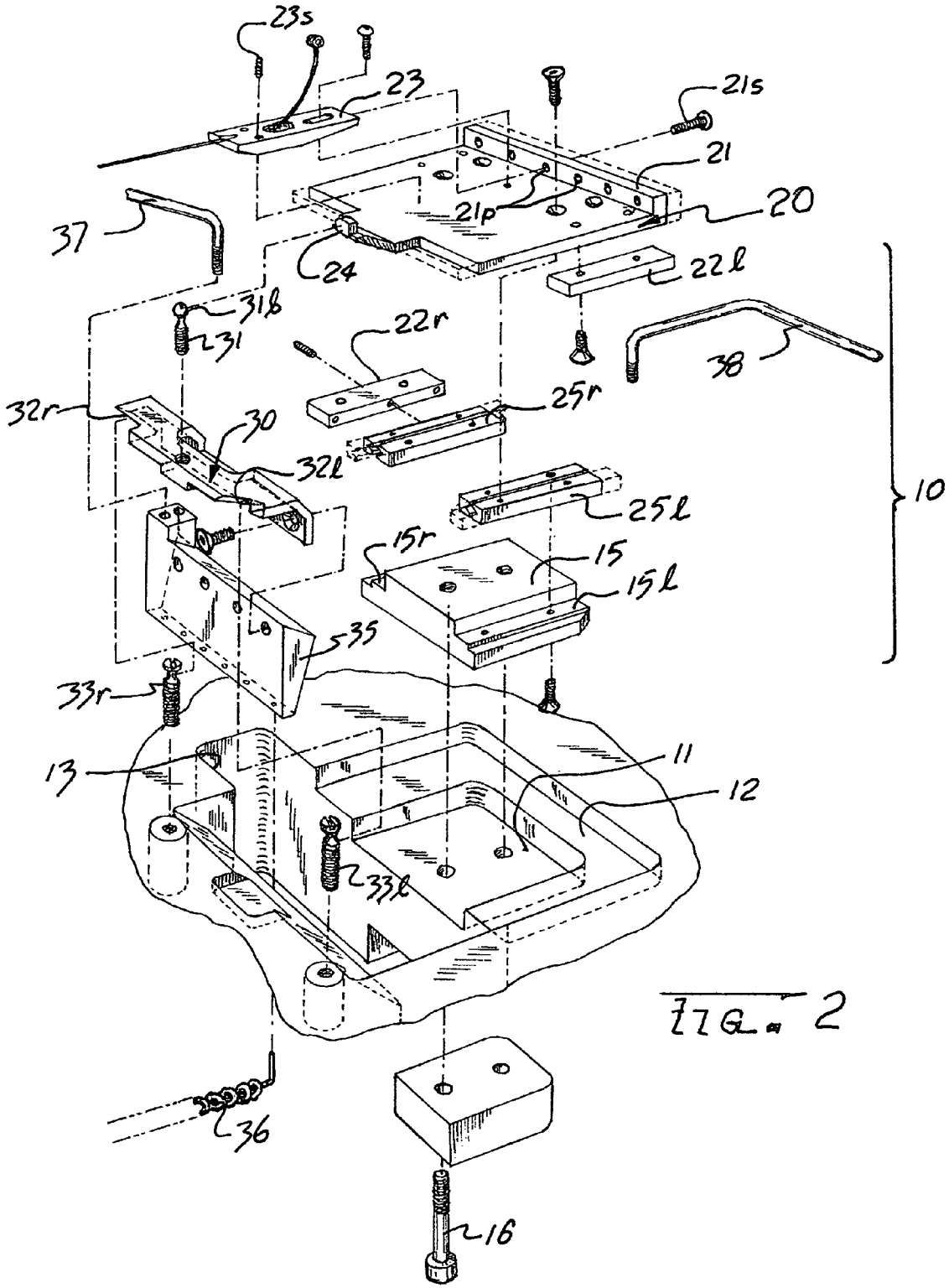
FIG. 2 is a perspective illustration, separated by parts, of the inventive bridge carrier and its articulation mechanism.

As shown in FIGS. 1 through 5 the inventive tremolo mechanism generally designated by the numeral 10 is installed into the body BD of a guitar GT at the location usually occupied by the string bridge from which the guitar strings GS are stretched over one or more pick-ups PU to extend over the neck NC. To accommodate the mechanism the guitar body BD is modified to include a generally rectangular base cavity 11 partly surrounded by a peripheral recess 12, with the base cavity then receiving a conforming rectangular base piece 15 secured in place by threaded fasteners 16 and 17. A generally planar bridge carrier 20 is then positioned within the recess 12 over base piece 15 with both the opposed longitudinal edges 15*l* and 15*r* of base piece 15 recessed to accept the interior portions of corresponding parallel slides 25*l* and 25*r* with the exterior portions thereof attached by strips 22*l* and 22*r* to each lateral edge of carrier 20. In this manner carrier 20 is engaged for sliding translation within the guitar body BD, displacing at the transverse rear edge thereof an upwardly turned lip 21 perforated with a row of openings 21*p* corresponding in number and in spacing to the number and spacing of the strings GS. Each one of these openings 21*p* then receives a screw 21*s* threadably engaged to a an end block 23 securing the ends of each individual one of the strings GS.

At the forward edge bridge carrier 20 is provided with an upwardly extending bearing surface 24 aligned to oppose a cam or ball end 31*b* of an adjustable screw 31 threaded into a transverse fulcrum piece 30 deployed to pivot within a transverse cavity 13 formed in front cavity 11. The pivoting fulcrum of piece 30 is then determined by the left and right forward edges 32*l* and 32*r* thereof, each shaped as a forwardly directed knife edge received within the waist pinch in corresponding reduced section portions of two threaded fulcrum posts 33*l* and 33*r*. A transverse spring bias arm 35 is then attached in cantilever to the rear surface of the fulcrum piece 30, extending into the interior of cavity 13 to engage a plurality of bias springs 36 therein. Thus the tuning tension of the strings GS and that of the bias springs 36 draws both the bridge carrier 20 and the fulcrum piece 30 forward, with the forward translation of the carrier 30 then opposed by contact between the ball end 31*b* and the bearing surface 24 while the forward translation of the fulcrum piece, in turn, is limited by the opposing contact between the knife edges 32*l* and 32*r* and the corresponding posts 33*l* and 33*r*.

It will be appreciated that the foregoing arrangement resolves all fore and aft motion of the carrier 20 at the contact point between the spherical surface of ball end 31*b* and the vertical plane of the bearing surface 24. In consequence this contact geometry essentially fixes the carrier motion to a horizontal plane that is further so limited by the longitudinal slides 25*l* and 25*r*, thereby eliminating all bending input to the strings GS. Moreover, the lever multiple advantage of the arm 35 relative the vertical spacing between the ball end 31*b* and the knife edges 32*l* and 32*r* allows for manipulative convenience in both directions, effected by a forwardly cantilevered tremolo bar 37 and a rearward tremolo bar 38 extending from arm 35. The geometric multiples of these cantilevered tremolo bars reduce even further the manual force levels required from the performer.

Those in the art will appreciate that in this arrangement the sole and substantial mode of carrier motion obtained by the manipulation of each of the tremolo bars is a linear motion in the plane of the strings GS. Thus the string ends are moved in unison exactly along their tuning axes allowing for precise control over their pitch modulation without any sound degradation or loss attributed to the mechanism. Moreover, the neutral point of this mechanism is developed at the hard cam interface between the ball end 31*b* and the surface 24, a hard interface that renders the tuning both positive and fixed. Further tuning precision is then obtained by the knife edge contacts of the edge segments 32*l* and 32*r* within the waist recesses on posts 33*l* and 33*r* with one edge segment 32*l* formed as a notched planform to fix and resolve all lateral force components by capturing the waist of post 33*l* in the notch.

Those in the art will further appreciate that the cam interface between the ball end 31*b* and its opposed surface 24 can be variously implemented by analogous mechanisms that resolve pivotal articulation into linear displacement. In each instance, however, it is the assembly convenience and the hard well fixed contacts that provide the necessary precision for effective use in the course of a performance. Furthermore, full adjustment convenience of each of the individual end blocks 23 is retained, including set screw pairs 23*s* for controlling the height of each string. In this manner all the tuning and adjustment features that are desired by a performer are retained in a mechanism that also accommodates tremolo manipulation.

It will be appreciated that the foregoing mechanism is particularly convenient in the course of adjusting or servicing the guitar once all the tension of strings GS is released. In this condition the bias arm 35 is free to pivot around the knife edge pivots formed by the interface of edges 32*l* and 32*r* with posts 33*l* and 33*r*, releasing the tension of bias springs 36 and allowing the disengagement of the fulcrum assembly. Once the fulcrum mechanism is removed the carrier 20 can be disengaged from the base piece, thus effecting a full disassembly that allows complete inspection, repair and adjustment. These conveniences are particularly significant for those performers that seek the necessary controls for optimizing tone quality of the instrument before a performance. Thus a simple and effective mechanism is provided that is particularly useful by those seeking optimum sound production.

Obviously many modifications and variations are possible without departing from the spirit of the invention instantly disclosed. It is therefore intended that the scope of the invention be determined solely by the claims appended hereto.

It is claimed:

1. In a guitar characterized by a body, a neck and a plurality of strings deployed thereover, the improvement comprising:

a bridge carrier including a transverse projection proximate the rear edge thereof conformed to adjustably engage the individual ends of each said string and a bearing projection proximate the forward end thereof;

a mount attachable to said body and including slide means for securing said carrier to said mount in a generally linear sliding engagement longitudinally along said strings;

a transversely aligned fulcrum structure deployed for pivotal motion about a pivot axis transversely aligned adjacent the forward end of said carrier and including cam means conformed to oppose said bearing projection upon the pivotal articulation thereof;

spring bias means connected between said body and said fulcrum structure for urging said cam means into contact with said bearing projection; and lever means cantilevered from said fulcrum structure and deployed for manual articulation thereof.

2. Apparatus according to claim 1, wherein:

said cam means includes a generally radial projection adjustable in radial length relative the pivot axis of said fulcrum structure.

3. In a guitar characterized by a body, a neck and a plurality of strings deployed thereover, the improvement comprising:

a bridge carrier including a transverse projection proximate the rear edge thereof conformed to adjustably engage the individual ends of each said string and a bearing projection proximate the forward end thereof;

a mount attachable to said body and including slide means for securing said carrier to said mount in a generally linear sliding engagement longitudinally along said strings;

a transversely aligned fulcrum structure deployed for pivotal motion about a pivot axis transversely aligned adjacent the forward end of said carrier and including cam means conformed to oppose said bearing projection upon the pivotal articulation thereof, said cain means including a generally radial projection adjustable in radial length relative the pivot axis of said fulcrum structure; spring bias means connected between said body and said fulcrum structure for urging said cam means into contact with said bearing projection; and lever means cantilevered from said fulcrum structure and deployed for manual articulation thereof, said lever means including a first and second lever cantilevered from said fulcrum structure to respectively extend adjacent said forward and said rear edges of said carrier.

4. Apparatus according to claim 3, wherein:

said mount, said fulcrum structure and said spring bias means are received within said guitar body.

5. Apparatus according to claim 4, further comprising:

said fulcrum structure includes lateral extensions each provided with sharp leading edge; and said body includes a pair of transversely spaced vertical posts each conformed to engage in opposition one of said leading edges on the respective lateral extensions.

6. Apparatus according to claim 5, wherein:

said posts are each threadably adjustable in their extension.

7. A tremolo assembly conformed for deployment in replacement for a bridge engaging the ends of guitar strings to the body of a guitar, comprising:

a generally planar bridge carrier including a front and a rear edge, a transverse projection extending beyond the plane of said carrier adjacent the rear edge conformed for operative engagement to the ends of each one of said guitar strings and an orthogonally aligned bearing surface formed on said front edge;

a slide assembly attached to said guitar body in the general alignment of said replaced bridge deploying a slide engaged to support said bridge carrier for sliding translation along said guitar strings;

a fulcrum piece pivotally mounted for pivotal motion around a transverse pivot axis on said guitar body including a cam projection extending radially beyond said pivot axis to oppose said bearing surface along one portion of the pivotal movement thereof;

bias spring means connected between said body and said fulcrum piece for urging said cam projection into contact with said bearing surface; and lever means cantilevered from said fulcrum piece and deployed for manual articulation thereof.

8. Apparatus according to claim 7, wherein:

said cam projection includes a radial projection threadably adjustable in its radial length relative the pivot axis of said fulcrum piece.

9. A tremolo assembly conformed for deployment in replacement for a bridge engaging the ends of guitar strings to the body of a guitar, comprising:

a generally planar bridge carrier including a front and a rear edge, a transverse projection extending beyond the plane of said carrier adjacent the rear edge conformed for operative engagement to the ends of each one of said guitar strings and an orthogonally aligned bearing surface formed on said front edge;

a slide assembly attached to said guitar body in the general alignment of said replaced bridge deploying a slide engaged to support said bridge carrier for sliding translation along said guitar strings;

a fulcrum piece pivotally mounted for pivotal motion around a transverse pivot axis on said guitar body including a cam projection extending radially beyond said pivot axis to oppose said bearing surface along one portion of the pivotal movement thereof, said cam projection including a radial projection threadably adjustable in its radial length relative the pivot axis of said fulcrum piece;

bias spring means connected between said body and said fulcrum piece for urging said cam projection into contact with said bearing surface; and lever means cantilevered from said fulcrum piece and deployed for manual articulation thereof, said lever means including a first and second lever cantilevered from said fulcrum piece to respectively extend adjacent said front and said rear edges of said carrier.

10. Apparatus according to claim 9, wherein:

said mount, said fulcrum piece and said spring bias means are each received within said guitar body.

11. Apparatus according to claim 10, further comprising:

said fulcrum piece includes lateral extensions each provided with sharp leading edge; and said body includes a pair of transversely spaced vertical posts each conformed to engage in opposition one of said leading edges on the respective lateral extensions.

12. Apparatus according to claim 11, wherein:

said posts are each threadably adjustable in their extension.

13. Apparatus for modulating in unison the string tension of guitar strings extended over the body of a guitar, comprising:

a generally planar bridge carrier including a front and a rear edge, a transverse projection extending beyond the plane of said carrier adjacent the rear edge conformed for operative engagement to the ends of each one of said guitar strings and an orthogonally aligned bearing surface formed on said front edge;

a slide assembly interposed between said body and said carrier to support said bridge carrier for sliding translation along said guitar strings;

a fulcrum piece pivotally mounted for pivotal motion around a pivot axis on said guitar body adjacent said front edge of said carrier, said piece including a cam projection extending radially beyond said pivot axis to oppose said bearing surface along one portion of the pivotal movement thereof;

bias spring means connected between said body and said fulcrum piece for urging said cam projection into contact with said bearing surface; and lever means cantilevered from said fulcrum piece and deployed for manual articulation thereof.

14. Apparatus according to claim 13, wherein:

said cam projection includes a radial projection threadably adjustable in its radial length relative the pivot axis of said fulcrum piece.

15. Apparatus for modulating in unison the string tension of guitar strings extended over the body of a guitar, comprising:

a generally planar bridge carrier including a front and a rear edge, a transverse projection extending beyond the plane of said carrier adjacent the rear edge conformed for operative engagement to the ends of each one of said guitar strings and an orthogonally aligned bearing surface formed on said front edge;

a slide assembly interposed between said body and said carrier to support said bridge carrier for sliding translation along said guitar strings;

a fulcrum piece pivotally mounted for pivotal motion around a pivot axis on said guitar body adjacent said front edge of said carrier, said piece including a cam projection extending radially beyond said pivot axis to oppose said bearing surface along one portion of the pivotal movement thereof, said cam projection including a radial projection threadably adjustable in its radial length relative the pivot axis of said fulcrum piece;

bias spring means connected between said body and said fulcrum piece for urging said cam projection into contact with said bearing surface; and lever means cantilevered from said fulcrum piece and deployed for manual articulation thereof, said lever means including a first and second lever cantilevered from said fulcrum piece to respectively extend adjacent said front and said rear edges of said carrier.

16. Apparatus according to claim 15, wherein:

said mount, said fulcrum piece and said spring bias means are each received within said guitar body.

17. Apparatus according to claim 16, further comprising:

said fulcrum piece includes lateral extensions each provided with sharp leading edge; and said body includes a pair of transversely spaced vertical posts each conformed to engage in opposition one of said leading edges on the respective lateral extensions.

18. Apparatus according to claim 17, wherein:

said posts are each threadably adjustable in their extension.

19. Apparatus according to claim 18, wherein:

each said post includes a pinched segment conformed to receive a corresponding one of said leading edges.

* * * * *